US008308513B2

(12) United States Patent
Hsu et al.

(10) Patent No.: US 8,308,513 B2
(45) Date of Patent: Nov. 13, 2012

(54) ELECTRICAL CONNECTOR

(75) Inventors: Kuo-Chun Hsu, New Taipei (TW); Chang-Hsien Tung, New Taipei (TW); Hui-Wen Yang, New Taipei (TW)

(73) Assignee: Hon Hai Precision Ind. Co., Ltd, New Taipei (TW)

( * ) Notice: Subject to any disclaimer, the term of this patent is extended or adjusted under 35 U.S.C. 154(b) by 0 days.

(21) Appl. No.: 13/088,413

(22) Filed: Apr. 17, 2011

(65) Prior Publication Data

US 2011/0256773 A1 Oct. 20, 2011

(30) Foreign Application Priority Data

Apr. 16, 2010 (TW) ..... 99206907

(51) Int. Cl.
*H01R 24/66* (2006.01)

(52) U.S. Cl. ..... 439/626

(58) Field of Classification Search ..... 439/626, 439/660, 607.13, 604.4, 83, 607.36, 74
See application file for complete search history.

(56) References Cited

U.S. PATENT DOCUMENTS 6,155,886 A * 12/2000 Koseki et al. ..... 439/736
D539,744 S * 4/2007 Hu et al. ..... D13/147
7,371,116 B2 * 5/2008 Chiang ..... 439/607.34
7,517,253 B1 * 4/2009 Chiang ..... 439/660
7,988,495 B2 * 8/2011 Chung ..... 439/660
8,025,532 B2 * 9/2011 Nagata et al. ..... 439/607.4
8,047,880 B2 * 11/2011 Fields et al. ..... 439/680
2005/0186843 A1 * 8/2005 Tsai ..... 439/607
2009/0042421 A1 * 2/2009 Zheng et al. ..... 439/83
2009/0042450 A1 2/2009 Zheng et al.
2010/0173529 A1 * 7/2010 He et al. ..... 439/660

* cited by examiner

*Primary Examiner* — Alexander Gilman
(74) *Attorney, Agent, or Firm* — Wei Te Chung; Ming Chieh Chang

(57) ABSTRACT

An electrical connector includes an insulative housing and contacts received therein. The insulative housing defines a retaining section and a mating tongue projecting beyond the retaining section perpendicularly. A plurality of terminal grooves are defined on the mating tongue and extending along a front-to-rear direction. A plurality of positioning slots are defined on the retaining section and extending along a vertical direction perpendicular to the front-to-rear direction and in communication with the terminal grooves respectively. Each contact comprises a contact portion secured in the terminal groove on the mating tongue and a solder tail secured in the positioning slot on the retaining section. The contacts are divided into signal contacts and grounding contacts, solder tails of said signal contacts and grounding contacts are separately located at different rows alone in the front-to-rear direction.

19 Claims, 6 Drawing Sheets

ELECTRICAL CONNECTOR

BACKGROUND OF THE INVENTION

1. Field of the Invention

The present invention relates to an electrical connector, and more particularly to an electrical connector having multiple sets of terminals.

2. Description of the Related Art

U.S. Pat. No. 7,744,426 discloses an electrical connector including an insulative housing and a plurality of contacts retained in the insulative housing. The insulative housing includes a base portion and a tongue portion protruding beyond the base portion. The tongue portion extends along a front-to-rear direction and includes a mating end opposite to the base portion. Each contact comprises an elastic contacting portion and a tail portion projecting out of the base portion for being mounted onto a printed circuit board. A spacer is provided for positioning the tail portions. However, the assembling of the spacer increases a manufacturing procedure, which is not advantage for the cost control. Moreover, if the number of the contacts increases, the distance between neighboring tail portions will be reduced, which may result in cross-talk. Obviously, an improved electrical connector is highly desired to overcome the aforementioned problem.

SUMMARY OF THE INVENTION

Accordingly, an object of the present invention is to provide an electrical connector which can prevent cross-talk between tail portions of the contacts.

In order to achieve the object set forth, an electrical connector adapted for soldering onto a printed circuit board comprises an insulative housing and a plurality of contacts received therein. The insulative housing defines a retaining section and a mating tongue projecting beyond the retaining section perpendicularly. A plurality of terminal grooves are defined on the mating tongue and extending along a front-to-rear direction. A plurality of positioning slots are defined on the retaining section and extending along a vertical direction perpendicular to the front-to-rear direction and in communication with the terminal grooves respectively. Each contact comprises a contact portion secured in the terminal groove on the mating tongue and a solder tail secured in the positioning slot on the retaining section. The contacts are divided into signal contacts and grounding contacts under condition that solder tails of said signal contacts and grounding contacts are separately located at different rows alone in the front-to-rear direction.

Other objects, advantages and novel features of the invention will become more apparent from the following detailed description of the present embodiment when taken in conjunction with the accompanying drawings.

DETAILED DESCRIPTION OF THE INVENTION

Figure 1:
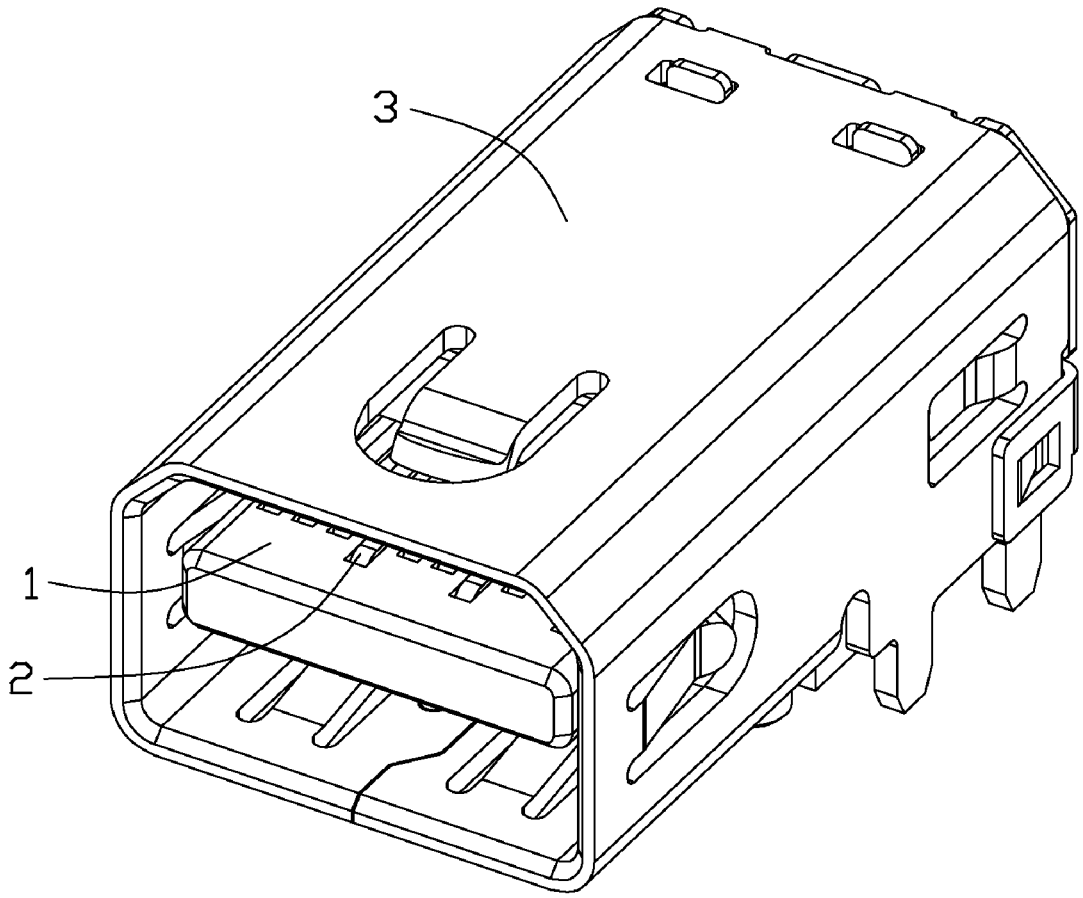
FIG. 1 is a perspective view of an electrical connector in accordance with the present invention.
Figure 2:
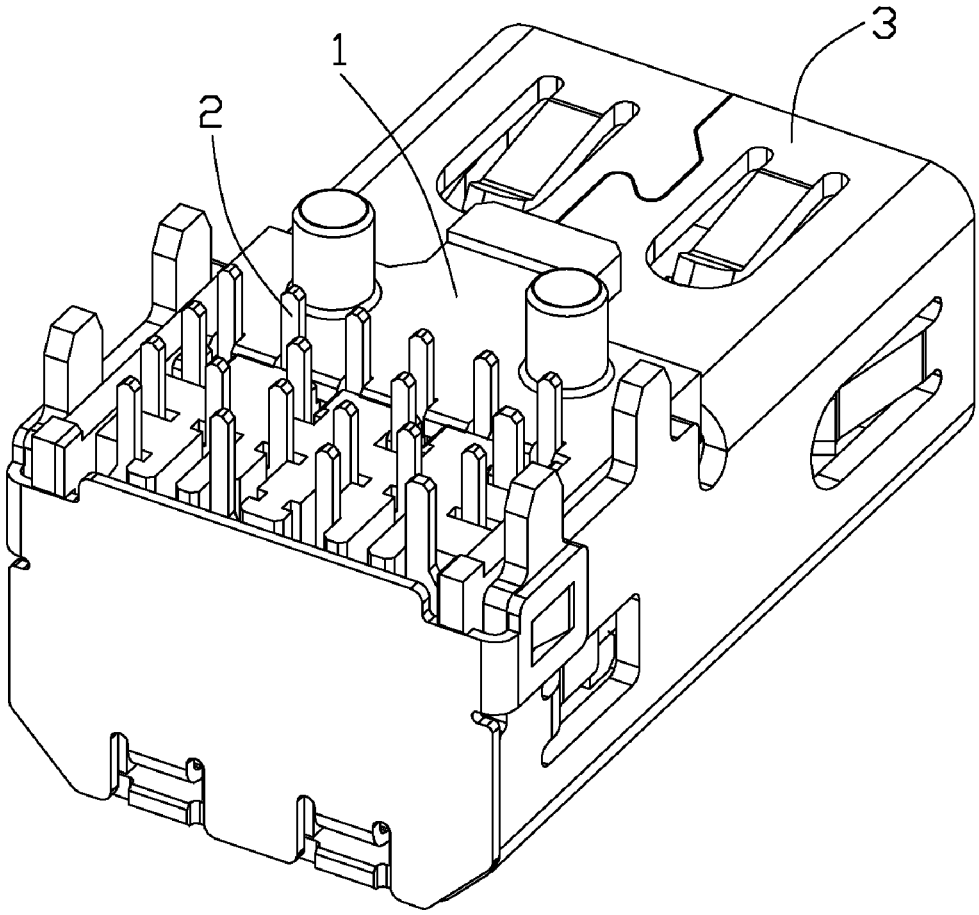
FIG. 2 is another perspective view of the electrical connector shown in FIG. 1.

Reference will now be made to the drawing figures to describe a preferred embodiment of the present invention in detail. Referring to FIGS. 1 and 2, an electrical connector made according to the preferred embodiment of the present invention is provided and comprises an insulative housing 1, a plurality of contacts 2 and a metallic shell 3 surrounding the insulative housing 1.

Figure 3:
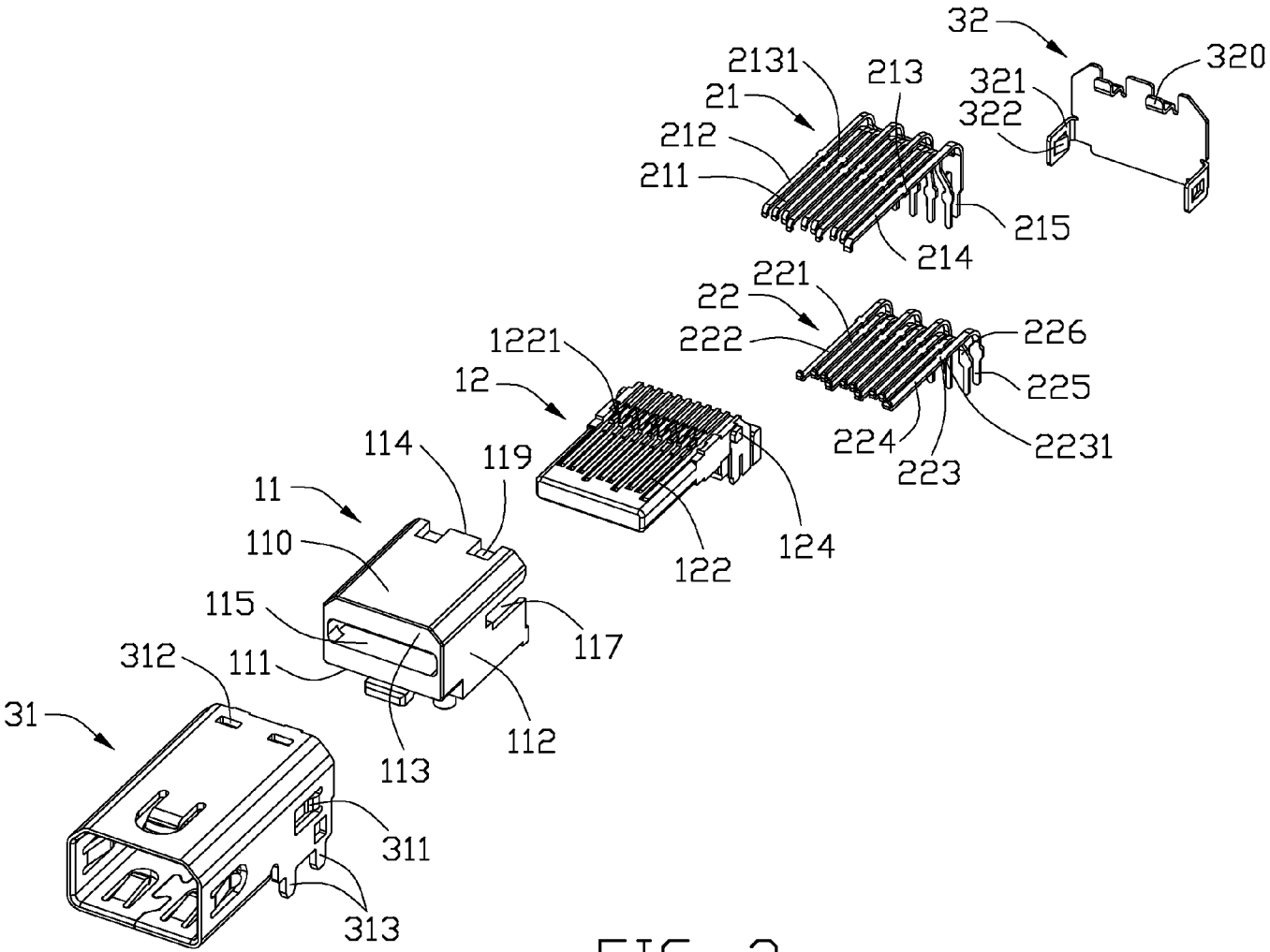
FIG. 3 is an exploded perspective view of the electrical connector shown in FIG. 1.
Figure 4:
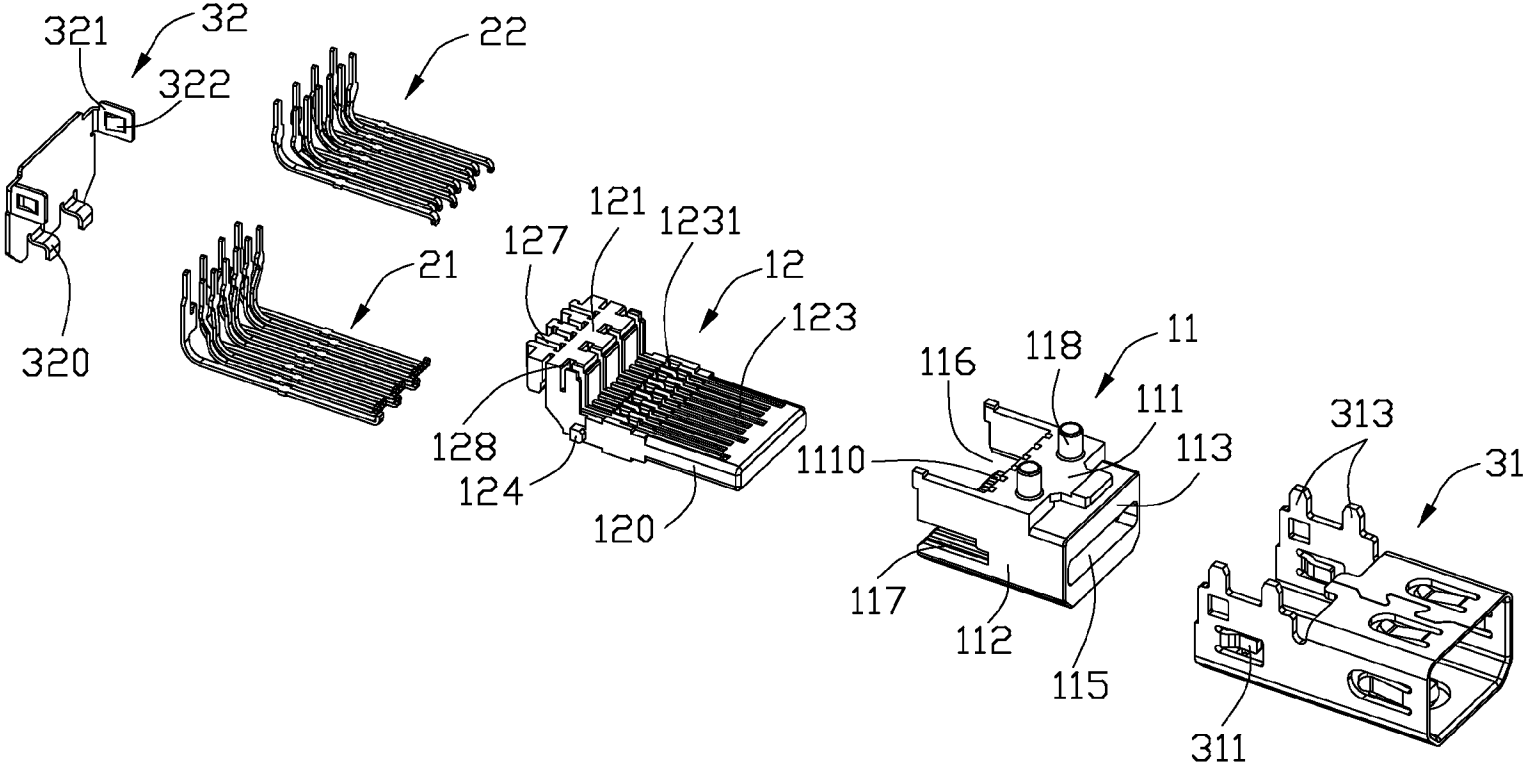
FIG. 4 is another exploded perspective view of the electrical connector shown in FIG. 1.
Figure 5:
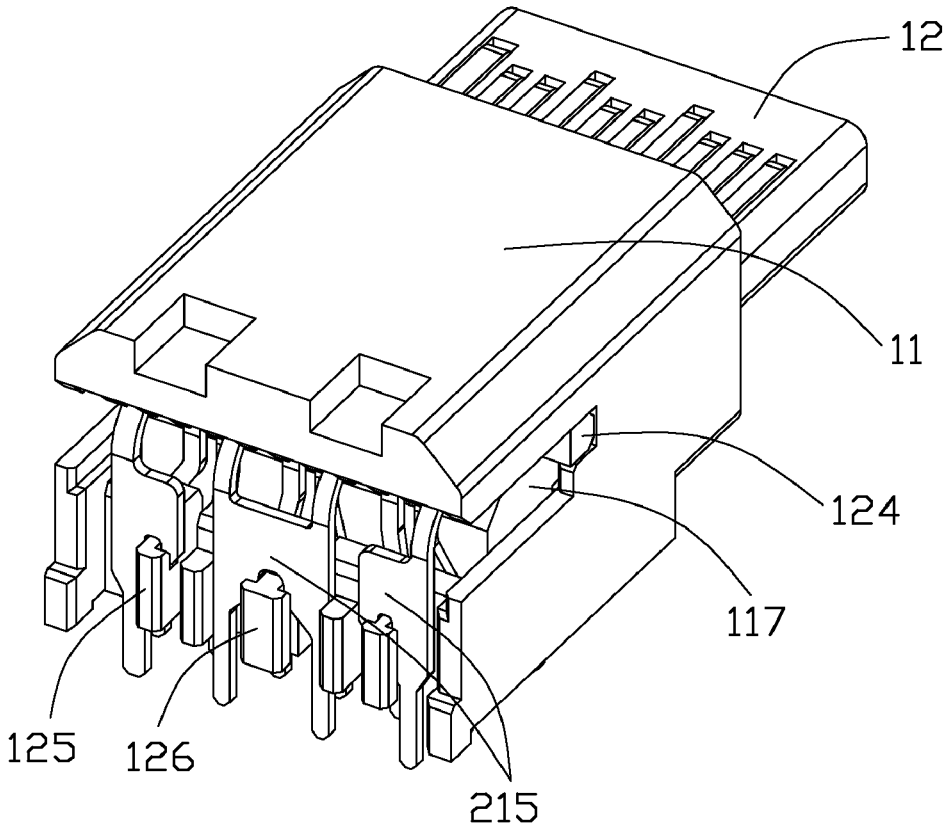
FIG. 5 is a perspective view of the electrical connector shown in FIG. 1 with a metallic shell removed.

Referring to FIG. 3 to FIG. 5, the insulative housing 1 comprises a first housing 11 configured as a rectangular shape, and a second housing 12 configured as an L shape and combined with the first housing 11. The first housing 11 comprises an upper wall 110, a lower wall 111, a pair of end walls 112 joining the upper and lower walls 110, 111, and a front wall 113 and a rear wall 114 connecting with the mentioned walls. The front wall 113 defines a receiving room 115 extending along a transverse direction and expanding along a front-to-rear direction so as to run through the first housing 11. A notch 116 is defined at the rear wall 114 and communicates with the receiving room 115. A pair of passageways 117 extending along the front-to-rear direction are defined at the end walls 112 and communicate with the notch 116. Further, a pair of positioning posts 118 extend downwardly from the lower wall 111 for positioning the electrical connector onto a printed circuit board (PCB).

The second housing 12 comprises a rear retaining section 121 and a tongue portion 120 projecting beyond the retaining section 121 from an upper portion thereof. A plurality of first terminal grooves 122 and second terminal grooves 123 are respectively defined on opposite sides of the tongue portion 120 for receiving contacts 2 therein. A widened recess 1221, 1231 is defined in each terminal groove 122, 123, and the neighboring recesses 1221, 1231 are in an offset manner thereby forming an S shaped configuration. A pair of blocks 124 are formed on opposite ends of the tongue portion 120 for being locked with the passageways 117 of the first housing 11. The second housing 12 is inserted into the receiving room 115 of the first housing 11 from a rear end thereof with the retaining section 121 received in the notch 116.

The contacts 2 include first contacts 21 received in the first terminal grooves 122 and second contacts 22 received in the second terminal grooves 123. Each first contact 21 comprises a retaining portion 213, a contacting portion 214 extending forwardly and horizontally from the retaining portion 213, and a pin shaped solder tail 215 extending rearwardly and bent downwardly. Moreover, a pair of ribs 2131 protrude laterally from each retaining portion 213 for providing retaining force when the first contact 21 is received in the first terminal grooves 122. The first contacts 21 comprise signal contacts 211 and grounding contacts 212. Contacting portions 214 of the first contacts 21 are located at a same plane, while the solder tails 215 of the signal contacts 211 and the grounding contacts 212 are respectively located at two different planes and arranged in an offset manner. As the solder tails 215 of the signal contacts 211 are separated from those of the grounding contacts 212, the distance between neighboring solder tails 215 can be increased so as to prevent cross-talk.

Each second contact 22 comprises a retaining portion 223, a contacting portion 224 extending forwardly and horizontally from the retaining portion 223, and a pin shaped solder tail 225 extending rearwardly and bent downwardly. Moreover, a pair of ribs 2231 protrude laterally from each retaining portion 223 for providing retaining force when the second contact 22 is received in the second terminal grooves 123. The second contacts 22 also include signal contacts 221 and grounding contacts 222. Contacting portions 224 of the second contacts 22 are located at a same plane, while solder tails 225 of the signal contacts 221 and grounding contacts 222 are respectively located at two different planes and arranged in an offset manner. Each of the outmost signal contacts 221 forms a curved portion 226 to make the corresponding solder tail 225 of the signal contact 221 to be in alignment with the solder tail 225 of the grounding contact 222. As the solder tails 225 of the signal contacts 221 are separated from those of the grounding contacts 222, the distance between neighboring solder tails 225 can be increased so as to prevent cross-talk.

Figure 6:
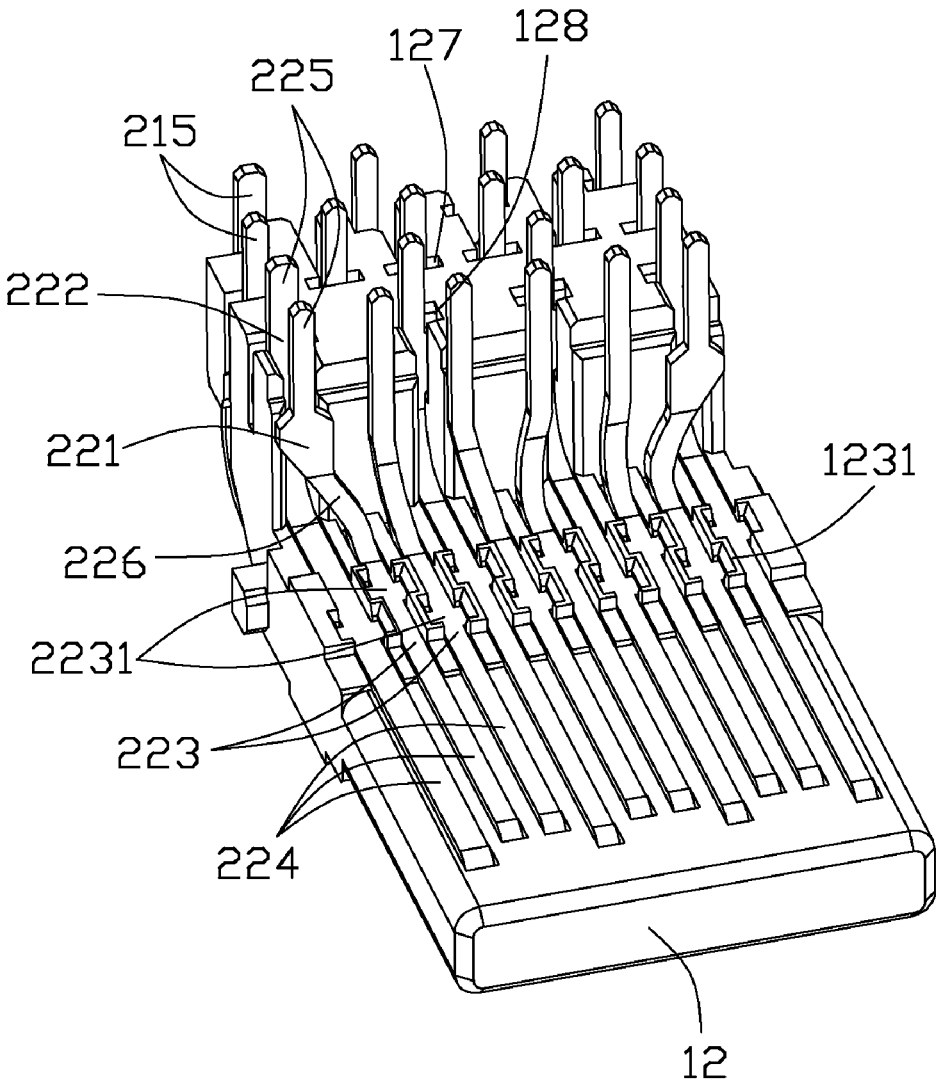
FIG. 6 is a partly assembled perspective view of the electrical connector shown in FIG. 1.

Referring to FIGS. 4~6, the retaining section 121 of the second housing 12 define a plurality of first slots 127 facing to a rear end and extending vertically to be in communication with the first terminal grooves 122, and a plurality of second slots 128 facing to the tongue portion 120 and extending vertically to be in communication with the second terminal grooves 123. A plurality of partitions 125, 126 are formed between neighboring first terminal grooves 122 and respectively configured as T shape and L shape for retaining the fork shaped solder tails 215 of the grounding contacts 212 of the first contacts 21.

Referring to FIG. 6, the first contacts 21 are downwardly inserted into the first terminal grooves 122 with the ribs 2131 received in the recesses 1221 therefore the first contacts 21 can not move along a front-to-rear direction. Meanwhile, the solder tails 215 of the signal contacts 211 are inserted into the first slots 127 and interfering with the first slots 127 for holding the first contacts 21 therein. While the fork shaped solder tails 215 of the grounding contacts 212 are fastened on the partitions 125, 126 and located behind the solder tails 215 of the signal contacts 211. The second contacts 22 are upwardly inserted into the second terminal grooves 123 with the ribs 2231 received in the recesses 1231 therefore the second contacts 22 can not move along the front-to-rear direction. Meanwhile, the solder tails 225 of the grounding contacts 222 are inserted into the second slots 128 and interfering with the second slots 128 for holding the second contacts 22 therein. While the solder tails 225 of the signal contacts 221 are located in front of the second slots 128 and abutting against a front surface of the retaining section 121. In the present invention, the solder tails 215 and 225 of the first contacts 21 and second contacts 22 are arranged into four rows, in the front-to-rear direction, respectively a first row with six signal contacts, a second row with four grounding contacts, a third row with six signal contacts, and a fourth row with four grounding contacts.

The first housing 11 defines a plurality of interval sections 1110 adjacent to the notch 116, therefore when the second housing 12 is inserted into the receiving room 115 of the first housing 11, the first row solder tails 225 of the second contacts 22 will be sandwiched between the interval sections 1110 and the front surface of the retaining section 121. In this situation, four rows of solder tails can reach to a required position without additional positioning elements. More importantly, as the contacts 2 are divided into several rows, distance (pitch) between neighboring contacts can be increased so as to prevent cross-talk.

The metallic shell 3 comprises a first shell 31 surrounding the first housing 11 and a second shell 32 covering the rear wall 114 of the first housing 11. The first shell 31 is made by stamping a metal sheet and bent into a rectangular shape so as to accommodate the first housing 11. A plurality of spring tabs 311 project inwardly for increasing the interfering force between the first shell 31 and the first housing 11. Solder legs 313 extend downwardly from the first shell 31 for mounting onto the PCB. A plurality of openings 312 are defined on the first shell 31 for receiving and locking with locking members 320 formed on the second shell 32. The second shell 32 forms a pair of wings 321 at opposite sides, on each of which an inwardly projecting plate 322 is formed for locking with the first shell 31.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector adapted for soldering onto a printed circuit board comprising:

an insulative housing defining a retaining section and a mating tongue projecting beyond the retaining section perpendicularly, a plurality of terminal grooves defined on the mating tongue and extending along a front-to-rear direction, a plurality of positioning slots defined on the retaining section and extending along a vertical direction perpendicular to the front-to-rear direction and in communication with the terminal grooves respectively; and a plurality of contacts, each comprising a contact portion secured in the terminal groove on the mating tongue and a solder tail secured in the positioning slot on the retaining section;

wherein said contacts are divided into signal contacts and grounding contacts under condition that solder tails of said signal contacts and grounding contacts are separately located at different rows alone in the front-to-rear direction; wherein said solder tails are arranged into four rows along the front-to-rear direction, a first row with signal contacts, a second row with grounding contacts, a third row with signal contacts, and a fourth row with grounding contact.

2. The electrical connector as described in claim 1, wherein said contacts comprises an upper row contacts and a lower row contacts with contact portions respectively located at upper and lower sides of the mating tongue and solder tails respectively located at front and rear sides of the retaining section.

3. The electrical connector as described in claim 1, wherein a pair of positioning posts are formed on a bottom side of the insulative housing and located in front of the first row with signal contacts.

4. The electrical connector as described in claim 3, wherein said four rows of solder tails are configured as pin shapes.

5. The electrical connector as described in claim 1, wherein each terminal groove defines a widened recess therein for receiving ribs formed on each contact.

6. An electrical connector, comprising:

a first housing defining a receiving room therein;

a second housing configured as an L shape and comprising a retaining section and a mating tongue extending forwardly from the retaining section perpendicularly, the mating tongue horizontally running through the receiving room of the first housing, a plurality of terminal grooves respectively defined on upper and lower sides of the mating tongue; and a plurality of contacts, divided into a first row contacts and a second row contacts, the second housing and the first row contacts being configured to have said first row contacts in a downward vertical direction inserted into the terminal grooves on the upper side with first solder tails positioned by the retaining section, while the second housing and the second row contacts being configured to have said second row contacts in an upward vertical direction inserted into the terminal grooves on the lower side with second solder tails positioned by the retaining section.

7. The electrical connector as described in claim 6, wherein a plurality of first slots and second slots are respectively defined in the retaining section for respectively positioning said first solder tails and second solder tails, and said first slots open rearwardly while said second slots open forwardly.

8. The electrical connector as described in claim 7, wherein a plurality of partitions are formed between neighboring first slots, said first solder tails comprise a first row engaging with said partitions and a second row received in said first slots.

9. The electrical connector as described in claim 8, wherein said first row solder tails are configured as fork shapes so as to fasten onto said partitions.

10. The electrical connector as described in claim 7, wherein said second solder tails comprise a third row received in the second slots, and a fourth row abutting against a front surface of the retaining section.

11. The electrical connector as described in claim 10, wherein said fourth row solder tails will be sandwiched between the retaining section and the first housing when the first and second housings are combined together.

12. The electrical connector as described in claim 7, wherein a notch is defined at a rear end of the first housing and in communication with the receiving room, said retaining section is received in said notch when the mating tongue runs through the receiving room in the first housing.

13. The electrical connector as described in claim 12, wherein a pair of passageways are defined on opposite sides of the first housing for receiving blocks formed on opposite sides of the retaining section.

14. The electrical connector as described in claim 13, wherein a metallic shell is provided for surrounding the first housing and the second housing.

15. The electrical connector as described in claim 14, wherein a pair of positioning posts are formed on a bottom side of the first housing and located in front of the retaining section of the second housing.

16. An electrical connector comprising:

a one-piece unitary insulative housing defining a first L-shaped configuration in a side view and including a rear vertical retention section and a front horizontal tongue portion extending therefrom, the vertical retention section defining opposite front and rear faces thereof and the horizontal tongue portion defining opposite upper and lower faces thereof, a plurality of rear slots and a plurality of front slots formed in the corresponding rear and front faces, respectively, a plurality of upper grooves and a plurality of lower grooves formed in the corresponding upper and lower faces, respectively;

a plurality of upper contacts defining a second L-shaped configuration in the side view, each of said upper contacts defining a horizontal upper contacting sections disposed in the corresponding upper groove and a vertical rear retention/tail section disposed in the corresponding rear slot; and a plurality of lower contacts defining a third L-shaped configuration in the side view, each of said lower contacts defining a horizontal lower contacting section disposed in the corresponding lower groove and a vertical front retention/tail section disposed in the corresponding front slot; wherein the upper grooves and the rear slots are configured to allow the corresponding upper contacts to be assembled thereinto in only a downward vertical direction, respectively, and the lower grooves and the front slots are configured to allow the corresponding lower contacts to be assembled therinto in only an upward vertical direction opposite to said downward vertical direction.

17. The electrical connector as claimed in claim 16, wherein the front slots are open to an exterior forwardly to allow extension of the lower contacting sections of the corresponding lower contacts, respectively, during upward insertion of the corresponding lower contacts into the front slots.

18. The electrical connector as claimed in claim 16, wherein said upper grooves and said lower grooves respectively define widened areas to compliantly receive widened sections of the corresponding upper contacting sections and lower contacting sections of the upper contacts and lower contacts, respectively.

19. The electrical connector as claimed in claim 16, wherein the front and rear slots define corresponding internal widened/stepped areas adapted to respectively confront widened/stepped structures of the corresponding front retention/tail sections and the rear retention/tail sections of the upper contacts and the lower contacts to prevent excessive movements of the corresponding front retention/tail sections and rear retention/tail sections therein during assembling the upper contacts and lower contacts into the housing.

* * * * *